US008155374B2

(12) United States Patent
Yuasa et al.

(10) Patent No.: US 8,155,374 B2
(45) Date of Patent: Apr. 10, 2012

(54) ELECTROACOUSTIC TRANSDUCING DEVICE

(75) Inventors: Hideo Yuasa, Shandong (CN); Hidenori Motonaga, Shandong (CN); Katsunari Fujita, Shandong (CN); Wei Wang, Shandong (CN)

(73) Assignee: Hosiden Corporation, Yao-shi, Osaka (JP)

( * ) Notice: Subject to any disclaimer, the term of this patent is extended or adjusted under 35 U.S.C. 154(b) by 406 days.

(21) Appl. No.: 12/453,496

(22) Filed: May 13, 2009

(65) Prior Publication Data

US 2009/0285439 A1 Nov. 19, 2009

(30) Foreign Application Priority Data

May 13, 2008 (JP) ..... 2008-125472

(51) Int. Cl.
*H04R 1/06* (2006.01)
*H04R 9/06* (2006.01)
*H04R 11/02* (2006.01)

(52) U.S. Cl. ..... 381/412; 381/400; 381/409

(58) Field of Classification Search ..... 381/412, 381/415, 396, 400, 405, 423, 409, 430
See application file for complete search history.

(56) References Cited

U.S. PATENT DOCUMENTS

| | | | | |
|---|---|---|---|---|
| 4,320,263 | A * | 3/1982 | Thiele | 381/415 |
| 7,106,879 | B2 * | 9/2006 | Yano | 381/396 |
| 7,346,182 | B2 * | 3/2008 | Sato et al. | 381/396 |
| 7,362,877 | B2 * | 4/2008 | Honda et al. | 381/409 |
| 2002/0175021 | A1 | 11/2002 | Moritake | |
| 2003/0219141 | A1 * | 11/2003 | Sugata et al. | 381/430 |
| 2004/0042633 | A1 * | 3/2004 | Sato et al. | 381/423 |
| 2004/0218779 | A1 | 11/2004 | Fukuyama et al. | |
| 2008/0063234 | A1 * | 3/2008 | Watanabe | 381/405 |
| 2009/0003644 | A1 * | 1/2009 | Furuya | 381/400 |

FOREIGN PATENT DOCUMENTS

| | | |
|---|---|---|
| EP | 0 650 308 A1 | 4/1995 |
| JP | 6178390 | 6/1994 |
| JP | 2007 166261 | 6/2007 |
| WO | WO 2008/018007 A2 | 2/2008 |

* cited by examiner

*Primary Examiner* — Walter L Lindsay, Jr.
(74) *Attorney, Agent, or Firm* — Bacon & Thomas, PLLC

(57) ABSTRACT

An electroacoustic transducing device comprising: a magnetic circuit having a yoke, a magnet, and a pole piece; a vibration system having a diaphragm and a voice coil; and a frame which holds the magnetic circuit and the vibration system. The voice coil is placed in a magnetic gap, and has lead wires of the voice coil which are drawn out from the voice coil at positions which are remote from the diaphragm. Openings for air forming for forming slack portions in the lead wires are drawn out from the voice coil and are disposed in the frame. The lead wires are adequately subjected to the wire laying process, and the audio performance is prevented from being lowered.

2 Claims, 9 Drawing Sheets

ELECTROACOUSTIC TRANSDUCING DEVICE

TECHNICAL FIELD

The present invention relates to an electroacoustic transducing device such as a small and thin speaker or receiver to be used in a portable telephone or the like.

BACKGROUND ART

An electroacoustic transducing device of this kind comprises: a magnetic circuit having a yoke, a magnet, and a pole piece; a vibration system having a diaphragm and a voice coil; and a frame which holds the magnetic circuit and the vibration system, and is configured so that the voice coil is placed in a magnetic gap. In the device, the diaphragm is placed on the magnetic circuit while an outer peripheral edge portion is bonded and fixed to the frame, and the voice coil in which a conductor wire is wound is placed in the magnetic gap while one end is bonded and fixed to the diaphragm.

In the thus configured electroacoustic transducing device, there is a conventional technique that, in order to improve the audio performance while reducing the diameter, a lead wire of the voice coil is drawn out from the voice coil at a position which is remote from the diaphragm, to the outside without being contacted with the diaphragm (see Patent Literature 1).

The conventional technique is effective also in the following point. In the case where the lead wire of the voice coil is drawn out from the voice coil at a position which is close to the diaphragm, when the voice coil and the diaphragm are to be bonded and fixed to each other, the one lead wire which is the winding start terminal is positioned on the inner circumferential side of the voice coil, and hence the winding start terminal must be drawn out toward the outer circumferential side of voice coil so as to bridge over the bonding face of the voice coil with respect to the diaphragm. Therefore, a surface rise corresponding to the diameter of one wire occurs in the vicinity of the terminal, so that the bonding face of the voice coil cannot be joined in parallel to that of the diaphragm. As a result, the bonding between the voice coil and the diaphragm becomes unstable, and the reliability of the bonding is reduced. In addition, the axis of the voice coil is inclined with respect to the vibration direction. Under the circumstances that reduced size and thickness are strongly requested and the size of the magnetic gap is restricted, when such an inclination occurs, the voice coil is easily contacted with the inner and outer components, or the yoke, the magnet, and the pole piece (see paragraphs [0002] and [0003] of Patent Literature 2).

In the above-described conventional technique, this problem does not occur.

PRIOR ART LITERATURE

[Patent Literature ]

[Patent Literature 1] Japanese Patent No. 3,098,127

[Patent Literature 2] Japanese Patent Application Laying-Open No. 2007-166261

SUMMARY OF THE INVENTION

[Problems to be Solved by the Invention ]

In the above-described conventional technique, however, the lead wire of the voice coil is not supported. In the configuration where the lead wire is simply laid and guided to a predetermined place so as not to be tensely stretched, therefore, a large influence is exerted on the vibration system, and the audio performance is lowered.

It is an object of the invention to provide an electroacoustic transducing device in which a lead wire drawn out from a voice coil at a position that is remote from a diaphragm can be adequately subjected to a wire laying process, so that the audio performance can be prevented from being lowered.

[Means for Solving the Problems ]

In order to attain the object, the invention provides an electroacoustic transducing device comprising: a magnetic circuit having a yoke, a magnet, and a pole piece; a vibration system having a diaphragm and a voice coil; and a frame which holds the magnetic circuit and the vibration system, the voice coil being placed in a magnetic gap, wherein lead wires of the voice coil are drawn out from the voice coil at positions which are remote from the diaphragm, and openings for air forming for forming slack portions in the lead wires drawn out from the voice coil are disposed in the frame.

According to the configuration, a wire laying process in which the lead wires drawn out from the voice coil at positions remote from the diaphragm are bent in the air (air forming) to form slack portions can be performed by using a forming jig which is inserted through the openings disposed in the frame, and the lead wires can be guided to predetermined places.

[Effects of the Invention ]

As described above, according to the invention, the lead wires of the voice coil are drawn out from the voice coil at positions which are remote from the diaphragm, and the openings for air forming for forming slack portions in the lead wires drawn out from the voice coil are disposed in the frame. Therefore, the lead wires drawn out from the voice coil at positions remote from the diaphragm can be adequately subjected to the wire laying process. Even when the lead wires of the voice coil are drawn out from the voice coil at positions remote from the diaphragm, therefore, the vibration system is less affected, and the audio performance can be prevented from being lowered.

MODE FOR CARRYING OUT THE INVENTION

Hereinafter, Embodiments 1 to 3 of the invention will be described with reference to the drawings.

[Embodiment 1]

Figure 1:
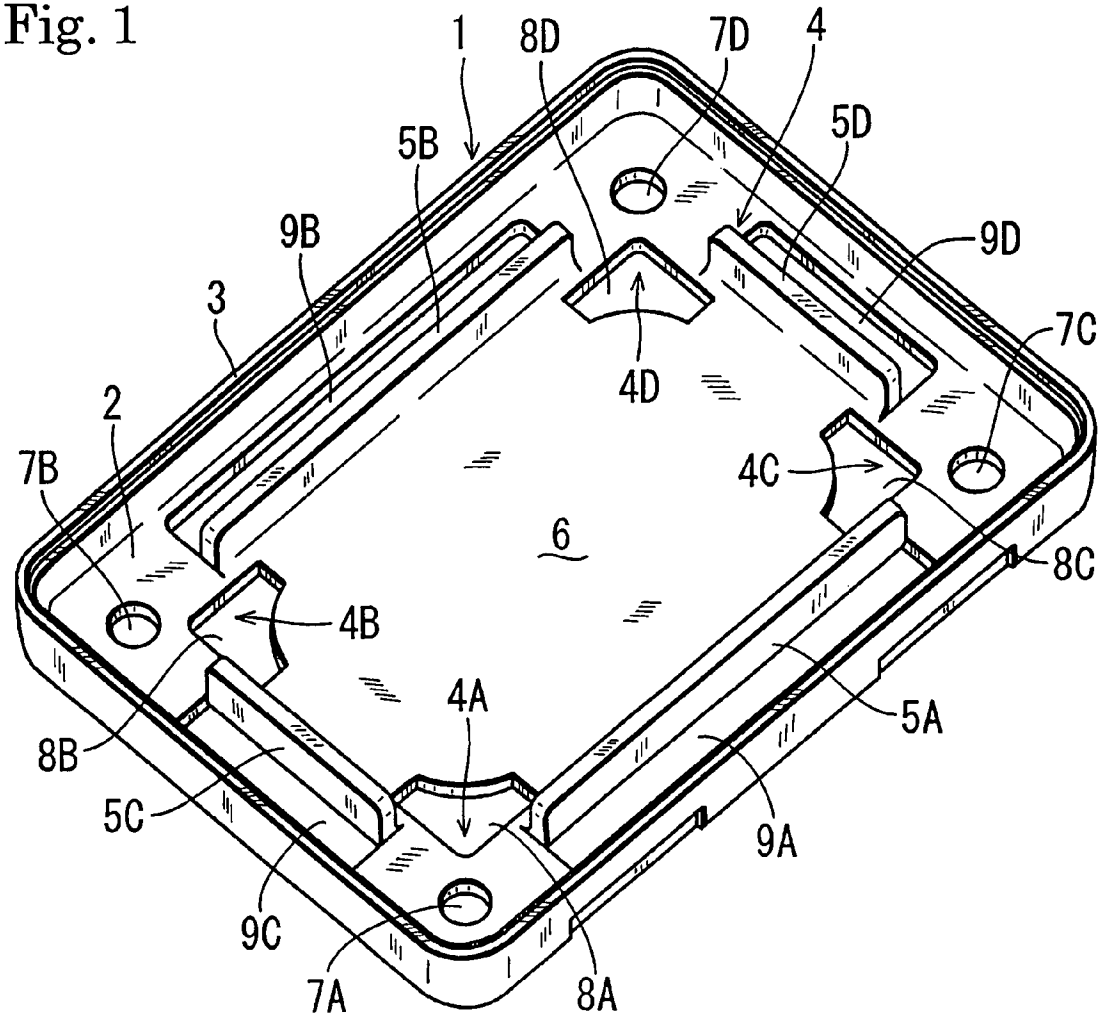
FIG. 1 is a perspective view of a frame in Embodiment 1 of the invention.

Embodiment 1 will be described with reference to FIGS. 1 to 4. FIG. 1 is a perspective view of a frame in the embodiment.

The frame 1 shown in FIG. 1 is formed into a shallow bottomed rectangular tubular shape which is configured by applying a pressing process (a drawing process) on one sheet-like metal material to form a rectangular bottom plate 2 and sidewalls 3 that are perpendicularly raised from the outer peripheral edge of the plates. Cutting and bending processes are performed on the bottom plate 2 to raise four outer side portions of the bottom plate 2, whereby a rectangular bottomed frame-like yoke portion 4 which is slightly smaller than the sidewall 3 is formed inside the sidewall 3. As a result, the frame is formed as a yoke-integral type.

The yoke portion 4 is configured by: four or front, rear, right, and left yoke sidewalls 5A, 5B, 5C, 5D which are opposed to the inside of the sidewall 3 across a predetermined space; and a rectangular yoke bottom plate 6 which is configured by a middle portion of the bottom plate 2 that is inside the yoke sidewalls 5A, 5B, 5C, 5D.

In the four corners of the yoke portion 4, gaps 4A, 4B, 4C, 4D between the yoke sidewalls 5A, 5B, 5C, 5D are formed. The inside of the yoke portion 4 communicates with an outer side portion in the frame 1 through the gaps 4A, 4B, 4C, 4D. The outer side portion is formed at the same height as the yoke portion around the yoke portion 4.

First openings 7A, 7B, 7C, 7D which are placed in the four corner portions of the bottom plate 2, respectively, and which are circular, and second openings 8A, 8B, 8C, 8D which comprise the gaps and which are placed in the four corner portions of the yoke bottom plate 6, respectively, and which have a substantially L-like shape are disposed in the frame 1. Front, rear, right, and left third openings 9A, 9B, 9C, 9D which are formed by raising the yoke sidewalls 5A, 5B, 5C, 5D from the bottom plate 2 are disposed in four places of an outer side portion of the bottom plate 2, respectively.

Figure 2:
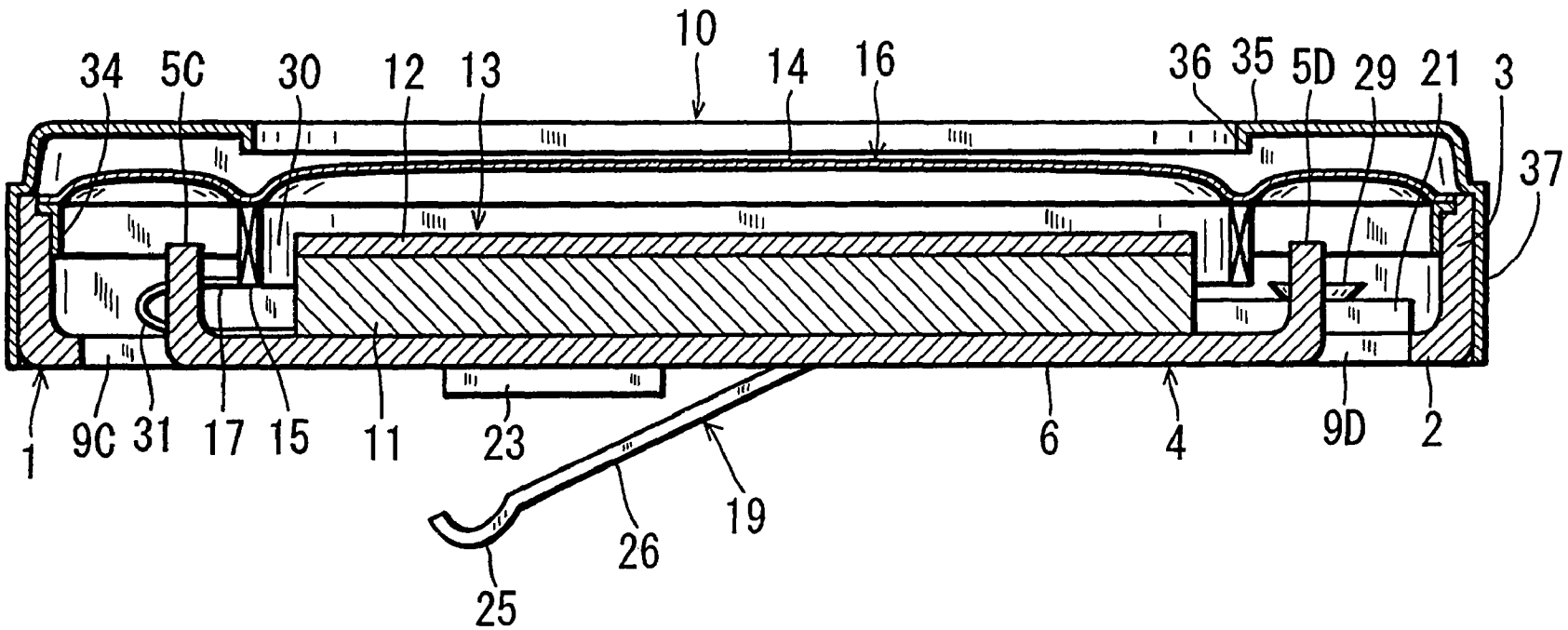
FIG. 2 is a mid-sectional view of a speaker (an example of the electroacoustic transducing device) in Embodiment 1 of the invention.
Figure 3:
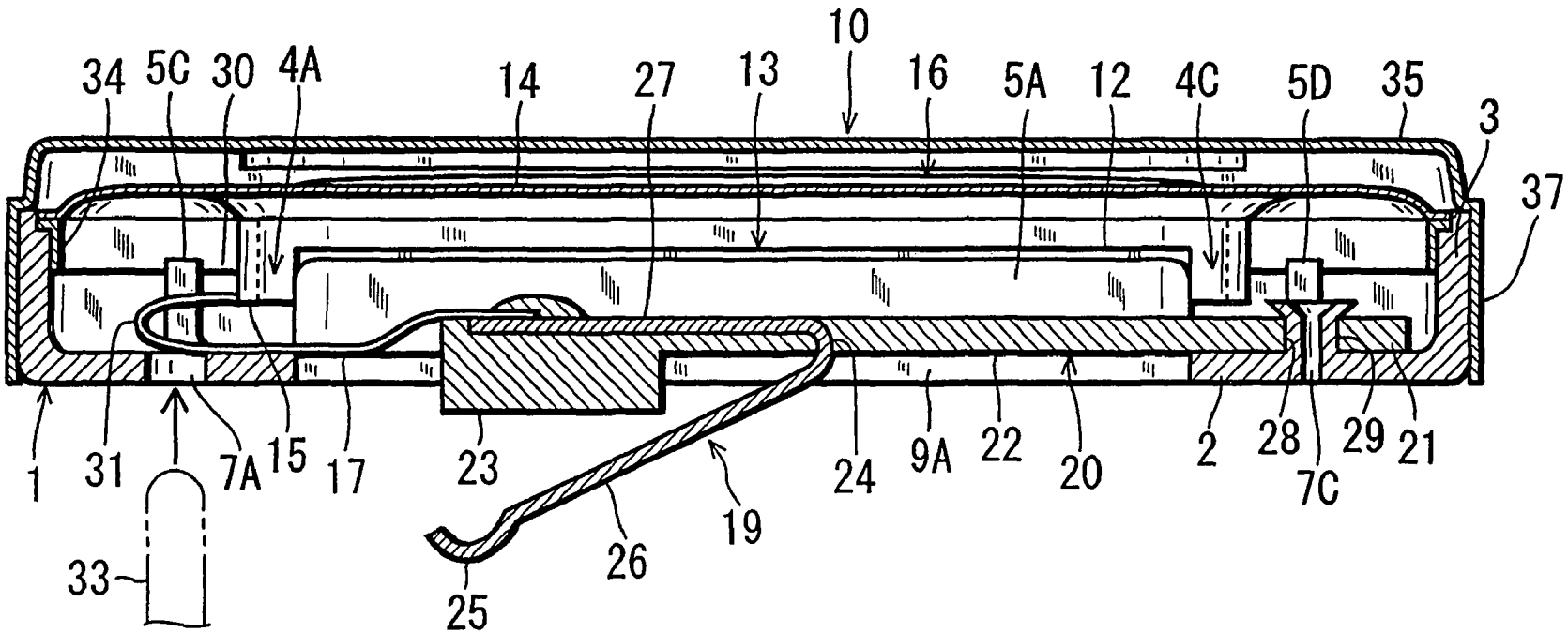
FIG. 3 is a longitudinal sectional view of a terminal portion of the speaker (an example of the electroacoustic transducing device) in Embodiment 1 of the invention.
Figure 4:
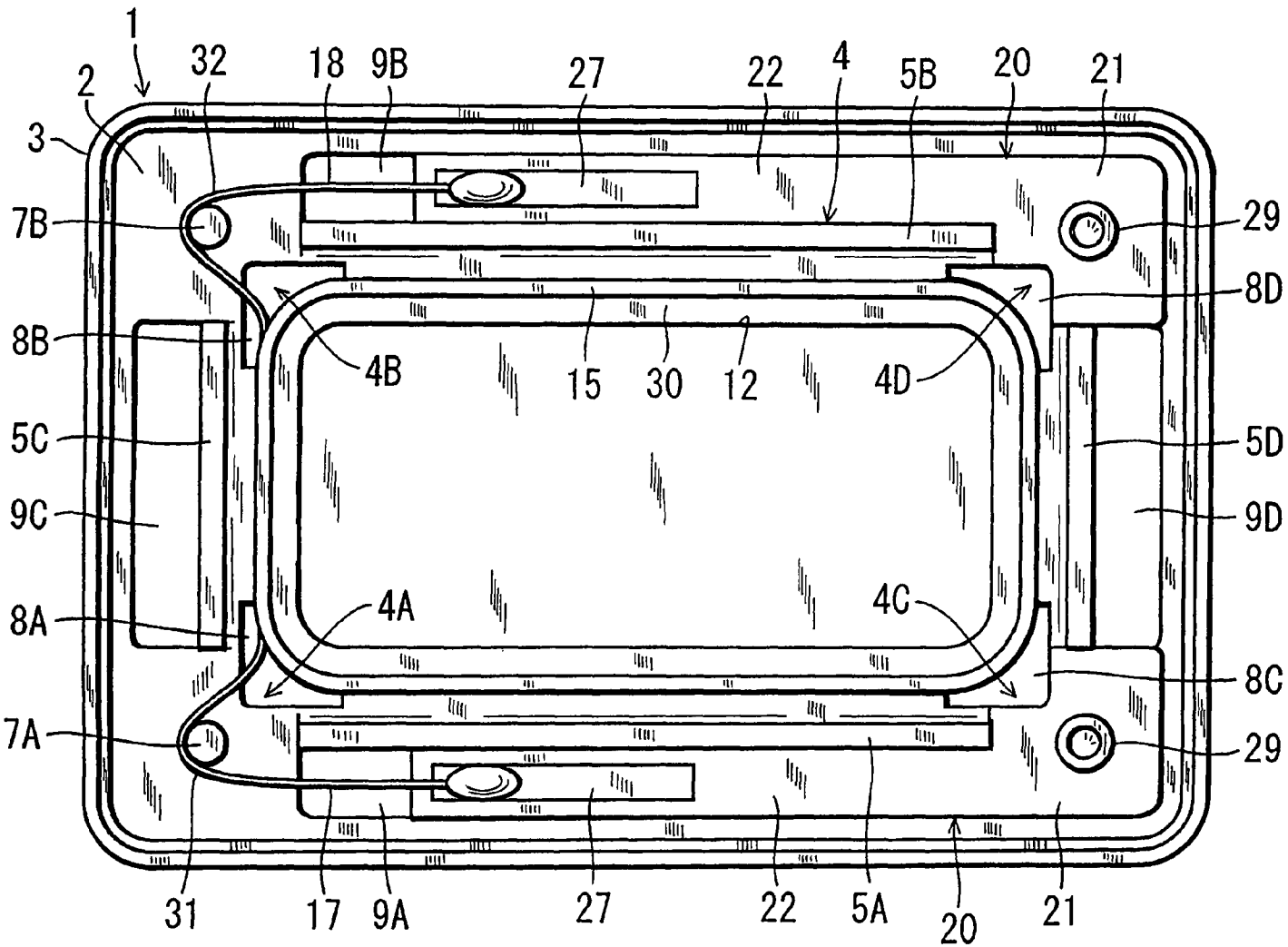
FIG. 4 is a plan view of a state where a baffle, a diaphragm, and a diaphragm ring are made transparent in the speaker (an example of the electroacoustic transducing device) in Embodiment 1 of the invention.

FIG. 2 is a mid-sectional view of a rectangular speaker (an example of the electroacoustic transducing device) which is assembled by using the frame shown in FIG. 1, FIG. 3 is a longitudinal sectional view of a terminal portion of the speaker, and FIG. 4 is a plan view of a state where a baffle, the diaphragm, and a diaphragm ring are made transparent in the speaker.

In the speaker 10 shown in FIGS. 2 to 4, a magnet 11 which is a rectangular columnar permanent magnet is bonded and fixed onto the yoke bottom plate 6, a pole piece 12 which is configured by a rectangular metal plate is bonded and fixed onto the magnet 11, and the yoke portion 4, the magnet 11, and the pole piece 12 constitute a magnetic circuit 13.

On the other hand, a rectangular diaphragm 14 which is configured by a resin or metal film, and a rectangular tubular voice coil 15 formed by winding a conductor wire in which the surface is covered by an insulating layer are concentrically bonded and fixed to each other, and the diaphragm 14 and the voice coil 15 constitute a vibration system 16.

When the diaphragm 14 and the voice coil 15 are to be bonded and fixed to each other, a lead wire drawn-out end portion and opposite end portion of the voice coil 15 are bonded and fixed to the diaphragm 14 so that one lead wire 17 which is the winding start terminal of the voice coil 15, and the other lead wire 18 which is the winding end terminal are drawn out from the voice coil 15 at positions that are remote from the diaphragm.

According to the noted configuration, the bonding face of the diaphragm can be joined in parallel to that of the voice coil. Therefore, the bonding between the diaphragm 14 and the voice coil 15 becomes stable, and the reliability of the bonding is enhanced.

A pair of external connection terminals 19 to which the lead wires 17, 18 drawn out from the voice coil 15 are respectively connected are attached to the frame 1. In this case, the four or front, rear, right, and left third openings 9A, 9B, 9C, 9D are used as drawn-out openings for the pair of external connection terminals 19, and rear sound holes for the speaker 10.

In the noted embodiment, among the four or front, rear, right, and left third openings 9A, 9B, 9C, 9D, the right and left third openings 9C, 9D which are formed by raising the right and left yoke sidewalls 5C, 5D on the short edge side from the bottom plate 2 are used as the rear sound holes, and the front and rear third openings 9A, 9B which are formed by raising the front and rear yoke sidewalls 5A, 5B on the long edge side are used as drawn-out openings for the pair of external connection terminals 19.

The external connection terminals 19 are formed by applying punching and bending processes on a thin metal plate, and integrated with a resin-made insulating member 20 by insert molding.

In the insulating member 20, an attaching portion 21 which is overlapped on and fixed to a corner portion of the bottom plate 2 which is on one lateral side (in the embodiment, the right side) of the front or rear third opening 9A or 9B functioning as a drawn-out opening for the external connection terminals 19 that is integrated with the insulating member, an extending portion 22 which extends from the attaching portion 21 onto the front or rear third opening 9A or 9B on one lateral side (in the embodiment, the left side), and a fitting portion 23 which projects from the lower face of the extending portion 22 to be fitted into the front or rear third opening 9A or 9B that is below the extending portion 22 are integrally formed.

In each of the external connection terminals 19, a fixing portion 24 which is embedded in a resin of the extending portion 22, a cantilever-like spring piece 26 which extends obliquely downwardly from the fixing portion 24 project at an incline from the bottom face of the frame 1 to the outside through the front or rear third opening 9A or 9B that is below the extending portion 22, and in which a contact portion 25 is formed in a projected end portion so that the lower face is convex and the upper face is concave, and a solder pad portion 27 which is embedded in the resin of the extending portion 22 so that one surface is exposed substantially flushly with the upper face of the extending portion 22, and which is conductingly connected to the fixing portion 24 are integrally formed.

In one of the external connection terminals 19, the attaching portion 21 is fixed onto the front right corner portion of the bottom plate 2, the spring piece 26 projects from the lower face of the frame 1 to the outside through the front third opening 9A, and the solder pad portion 27 is exposed from an outer bottom portion of the front yoke sidewall 5A in the frame 1. In the other external connection terminal 19, the attaching portion 21 is fixed onto the rear right corner portion of the bottom plate 2, the spring piece 26 is projected from the lower face of the frame 1 to the outside through the rear third opening 9B, and the solder pad portion 27 is exposed from an outer bottom portion of the rear yoke sidewall 5B in the frame 1.

Each of the external connection terminals 19 is fixed to the frame 1 in the following manner. A through hole 28 extending between the upper and lower faces of the attaching portion 21 is previously formed in the portion, and a cylindrical raised portion 29 is formed by a burring process around the first opening 7C or 7D in the corner portion of the bottom plate 2 on which the attaching portion 21 is to be overlaid is previously formed. When the attaching portion 21 is to be overlaid on the corner portion of the bottom plate 2, the raised portion 29 is passed through the through hole 28 from the lower face side of the attaching portion 21 to the upper face side. A crushing process is applied on an end portion of the raised portion 29 which is projected from the upper face of the attaching portion 21.

In the two lead wires 17, 18 drawn out from the voice coil 15, the one lead wire 17 is connected by soldering to the solder pad portion 27 of one of the external connection terminals 19, and the other lead wire 18 is connected by soldering to the solder pad portion 27 of the other external connection terminal 19. An outer peripheral edge portion of the diaphragm 14 is bonded and fixed to the sidewall 3 of the frame 1. The voice coil 15 is inserted into a magnetic gap 30 which is below the diaphragm 14. The magnetic circuit 13 and the vibration system 16 are held by the frame 1, thereby completing the speaker.

As shown in FIGS. 2 to 4, the two lead wires 17, 18 which are drawn out from the voice coil 15 are laid in the frame 1 to form slack portions 31, 32, guided to the solder pad portions 27 of the external connection terminals 19 to which the lead wires are to be connected, and then connected thereto by soldering.

In the wire laying process, as described above, the two lead wires 17, 18 of the voice coil 15 are drawn out from the voice coil 15 at positions which are remote from the diaphragm 14, i.e., an end portion (lower end portion) which is opposite to a diaphragm-bonded end portion (upper end portion) of the voice coil 15, and form the voice coil 15 in two places which are close to the left front and rear corner portions of the bottom plate 2 where the remaining two first openings 7A, 7B that are not used in the fixation of the external connection terminals 19 to the frame 1 exist, i.e., the left front and rear edge portions of the voice coil 15.

Pin-like forming jigs 33 having a circular section shape are inserted from the lower side of the frame 1 into the two first openings 7A, 7B in the left front and rear corner portions of the bottom plate 2, and extended into the left front and rear corner portions of the frame 1.

Since the outer side portion of the frame 1 is formed at the same height as the yoke portion around the yoke portion 4, the one lead wire 17 drawn out from the left front edge portion of the lower end portion of the voice coil 15 is drawn out to the left front corner portion of the frame 1 through the gap 4A between the front yoke sidewall 5A and the left yoke sidewall 5C, hooked around one of the forming jigs 33 which extends therein, and, in the hooked state, pulled toward the solder pad portion 27 of the external connection terminal 19 to which the lead wire is to be connected, and which is exposed in the outer bottom portion of the front yoke sidewall 5A in the frame 1, to be guided to the solder pad portion 27 while forming the substantially U-like slack portion 31 in the left front corner portion of the frame 1.

Since the outer side portion of the frame 1 is formed at the same height as the yoke portion around the yoke portion 4, the other lead wire 18 drawn out from the left rear edge portion of the lower end portion of the voice coil 15 is drawn out to the left rear corner portion of the frame 1 through the gap 4B between the rear yoke sidewall 5B and the left yoke sidewall 5C, hooked around the other forming jig 33 which extends therein, and, in the hooked state, pulled toward the solder pad portion 27 of the external connection terminal 19 to which the lead wire is to be connected, and which is exposed in the outer bottom portion of the rear sidewall 5B in the frame 1, to be guided to the solder pad portion 27 while forming the substantially U-like slack portion 32 in the left rear corner portion of the frame 1.

After the wire laying process is performed, the lead wires 17, 18 of the voice coil 15 are connected by soldering to the solder pad portions 27 of the external connection terminals 19 to which the lead wires are to be connected, respectively. Then, the back face of the diaphragm 14 is bonded and fixed in a concentric manner to the lead wire drawn-out end portion and opposite end portion of the voice coil 15, and the outer peripheral edge portion of the diaphragm 14 is bonded and fixed to the sidewall 3 of the frame 1.

The thus configured speaker 10 is used in, for example, a portable telephone. When an electric audio signal is supplied from an external circuit to the voice coil 15 through the pair of external connection terminals 19, the interaction between the magnetic field generated in the magnetic circuit 13 and that generated as a result of the energization of the voice coil 15 causes the voice coil 15 to vertically vibrate, and, in accordance with this, the diaphragm 14 vertically vibrates to generate a sound.

According to the above-described configuration, the lead wires 17, 18 of the voice coil 15 are drawn out from the voice coil 15 at positions which are remote from the diaphragm 14, and the openings 7A, 7B for air forming for forming the slack portions 31, 32 in the lead wires 17, 18 drawn out from the voice coil 15 are disposed in the frame 1. Therefore, the lead wires 17, 18 drawn out from the voice coil 15 at positions remote from the diaphragm 14 can be adequately subjected to the wire laying process. Even when the lead wires 17, 18 of the voice coil 15 are drawn out from the voice coil 15 at positions remote from the diaphragm 14, therefore, the vibration system 16 is less affected, and the audio performance can be prevented from being lowered.

When the lead wires 17, 18 of the voice coil 15 are drawn out from the voice coil 15 at positions remote from the diaphragm 14, the bonding face of the diaphragm can be joined in parallel to that of the voice coil. Therefore, the bonding between the diaphragm 14 and the voice coil 15 becomes stable, and the reliability of the bonding is enhanced. Moreover, the axis of the voice coil 15 is parallel to the vibration direction (the lateral direction of the sheet in FIGS. 2 and 3). Under the circumstances that reduced size and thickness are strongly requested and the size of the magnetic gap 30 is restricted, therefore, the voice coil 15 is hardly contacted with the yoke sidewalls 5A, 5B, 5C, 5D, magnet 11, and pole piece 12 which are inside and outside the voice coil.

In the embodiment, as shown in FIGS. 2 and 3, a rectangular diaphragm ring 34 is bonded and fixed to an outer peripheral edge portion of the diaphragm 14, and the outer peripheral edge portion of the diaphragm 14 is bonded and fixed to the sidewall 3 of the frame 1 through the diaphragm ring 34. A rectangular baffle 35 which covers an upper opening of the frame 1 is disposed. The baffle 35 is formed by performing a pressing process on a metal plate, and has a front sound hole 36 which is opposed to the diaphragm 14. A rectangular tubular edge portion 37 hangs from an outer peripheral edge portion of the baffle. The edge portion 37 is fitted to the outside of the sidewall 3 to be coupled with the frame 1.

[Embodiment 2]

Figure 5:
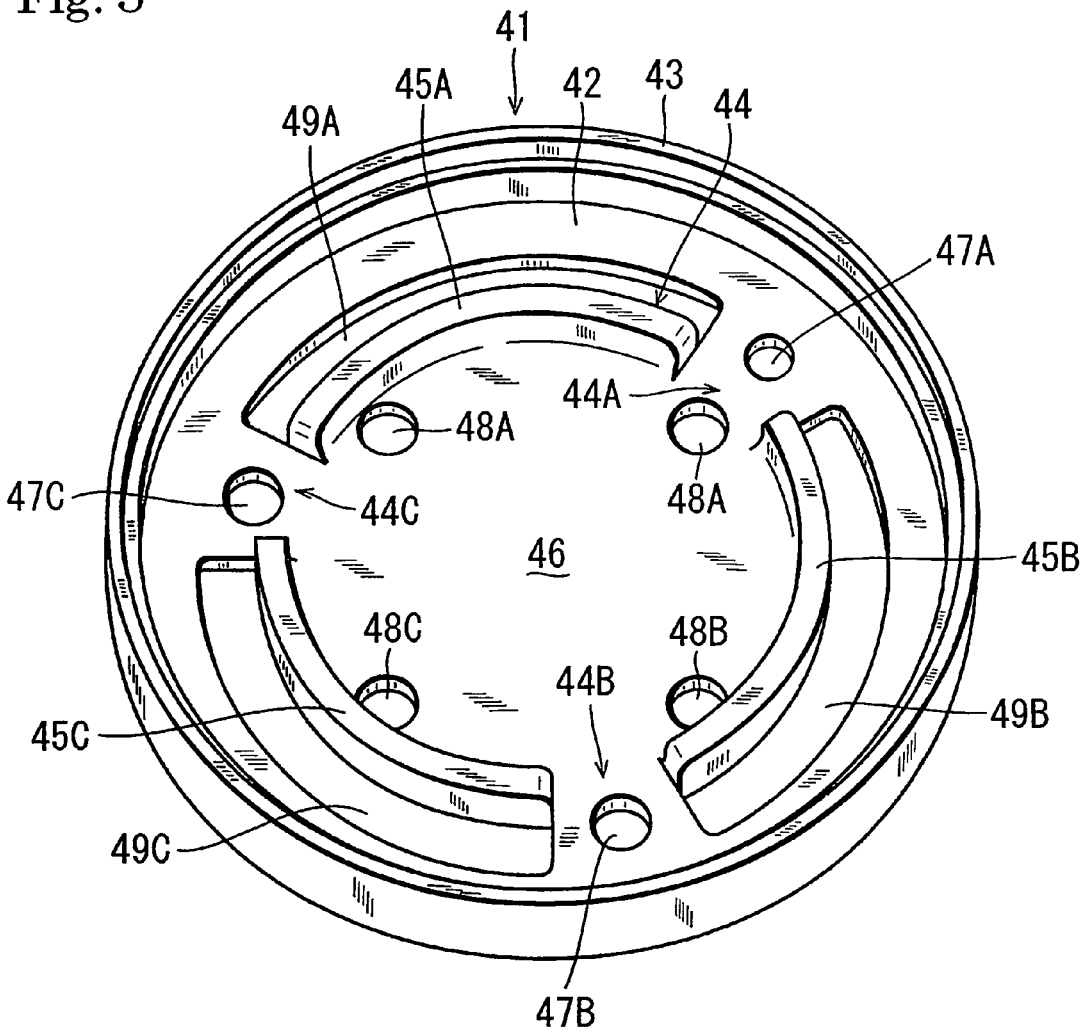
FIG. 5 is a perspective view of a frame in Embodiment 2 of the invention.

Embodiment 2 will be described with reference to FIGS. 5 to 7. FIG. 5 is a perspective view of a frame in the embodiment.

The frame 41 shown in FIG. 5 is formed into a shallow bottomed rectangular tubular shape which is configured by applying a pressing process (a drawing process) on one sheet-like metal material to form a circular bottom plate 42 and a sidewall 43 that is perpendicularly raised from the outer peripheral edge of the plate. Cutting and bending processes are performed on the bottom plate 42 to raise three outer side portions of the bottom plate 42, whereby a circular bottomed frame-like yoke portion 44 which is slightly smaller than the sidewall 43 is formed inside the sidewall 43. As a result, the frame is formed as a yoke-integral type.

The yoke portion 44 is configured by: three yoke sidewalls 45A, 45B, 45C which are opposed to the inside of the sidewall 43 across a predetermined space, and which are arcuately curved; and a circular yoke bottom plate 46 which is configured by a middle portion of the bottom plate 42 that is inside the yoke sidewalls 45A, 45B, 45C.

In an outer side portion of the yoke portion 44, gaps 44A, 44B, 44C between the yoke sidewalls 45A, 45B, 45C are formed at substantially regular intervals. The inside of the yoke portion 44 communicates with an outer side portion in the frame 41 through the gaps 44A, 44B, 44C. The outer side portion is formed at the same height as the yoke portion around the yoke portion 44.

First openings 47A, 47B, 47C which are placed between the yoke sidewalls 45A, 45B, 45C of the bottom plate 42, respectively, and which are circular, and four second openings 48A, 48B, 48C, 48D which are placed at substantially regular intervals in an outer side portion of the yoke bottom plate 46, respectively, and which are circular. Third openings 49A, 49B, 49C which are formed at substantially regular intervals by raising the yoke sidewalls 45A, 45B, 45C from the bottom plate 42 are disposed in three places of an outer side portion of the bottom plate 42, respectively.

Figure 6:
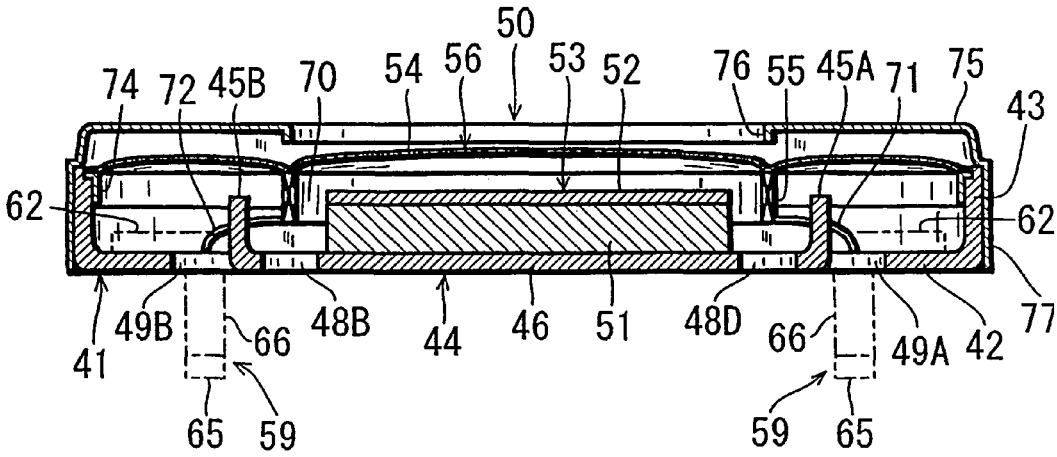
FIG. 6 is a mid-sectional view of a speaker (an example of the electroacoustic transducing device) in Embodiment 2 of the invention.
Figure 7:
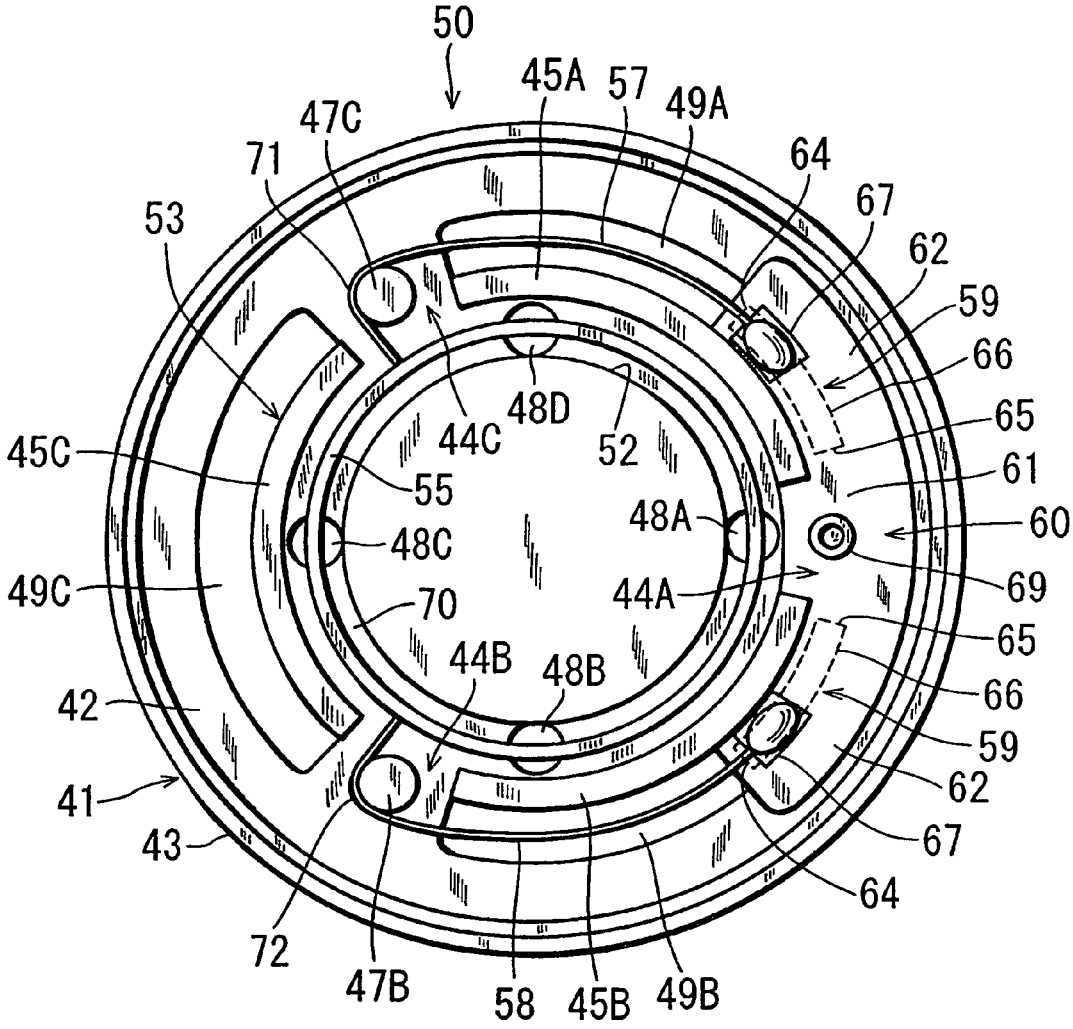
FIG. 7 is a plan view of a state where a baffle, a diaphragm, and a diaphragm ring are made transparent in the speaker (an example of the electroacoustic transducing device) in Embodiment 2 of the invention.

FIG. 6 is a mid-sectional view of a circular speaker (an example of the electroacoustic transducing device) which is assembled by using the frame shown in FIG. 5, and FIG. 7 is a plan view of a state where a baffle, the diaphragm, and a diaphragm ring are made transparent in the speaker.

In the speaker 50 shown in FIGS. 6 and 7, a magnet 51 which is a columnar permanent magnet is bonded and fixed onto the yoke bottom plate 46, a pole piece 52 which is configured by a circular metal plate is bonded and fixed onto the magnet 51, and the yoke portion 44, the magnet 51, and the pole piece 52 constitute a magnetic circuit 53.

On the other hand, a circular diaphragm 54 which is configured by a resin or metal film, and a cylindrical voice coil 55 formed by winding a conductor wire in which the surface is covered by a insulating layer are concentrically bonded and fixed to each other, and the diaphragm 54 and the voice coil 55 constitute a vibration system 56.

When the diaphragm 54 and the voice coil 55 are to be bonded and fixed to each other, a lead wire drawn-out end portion and opposite end portion of the voice coil 55 are bonded and fixed to the diaphragm 54 so that one lead wire 57 which is the winding start terminal of the voice coil 55, and the other lead wire 58 which is the winding end terminal are drawn out from the voice coil 55 at positions that are remote from the diaphragm 54.

According to the configuration, the bonding face of the diaphragm can be joined in parallel to that of the voice coil. Therefore, the bonding between the diaphragm 54 and the voice coil 55 becomes stable, and the reliability of the bonding is enhanced.

A pair of external connection terminals 59 to which the lead wires 57, 58 drawn out from the voice coil 55 are respectively connected are attached to the frame 41. In this case, the three third openings 49A, 49B, 49C are used as drawn-out openings for the pair of external connection terminals 59, and rear sound holes for the speaker 50.

The external connection terminals 59 are formed by applying punching and bending processes on a thin metal plate, and integrated with a single resin-made insulating member 60 by insert molding.

In the insulating member 60, an attaching portion 61 which is overlapped on and fixed to the gap 44A between the two yoke sidewalls 45A, 45B of the bottom plate 42, and an arcuate extending portion 62 which extends from both sides of the attaching portion 61 and on substantially halves of the two third openings 49A, 49B which are disposed on the bottom plate 42 by raising the two yoke sidewalls 45A, 45B that sandwich the attaching portion 61 from the bottom plate 42 are integrally formed.

In each of the external connection terminals 59, a fixing portion 64 which is embedded in a resin of the extending portion 62, a cantilever-like spring piece 66 which extends obliquely downwardly from the fixing portion 64 along the lower third opening 49A or 49B to project inclinedly projected from the bottom face of the frame 41 to the outside through the lower third opening 49A or 49B, and in which a contact portion 65 is formed in a projected end portion so that the lower face is convex and the upper face is concave, and a solder pad portion 67 which is embedded in the resin of the extending portion 62 so that one surface is exposed from the upper face of the extending portion 62, and which is conductingly connected to the fixing portion 64 are integrally formed.

In one of the external connection terminals 59, the spring piece 66 is projected from the lower face of the frame 41 to the outside through the third opening 49A which is on the lower side of the tip end side of the one the extending portion 62, and the solder pad portion 67 is exposed from an outer bottom portion of the yoke sidewall 45A in the frame 41. In the other external connection terminal 59, the spring piece 66 projects from the lower face of the frame 41 to the outside through the third opening 49B which is on the lower side of the tip end side of the other extending portion 62, and the solder pad portion 67 is exposed from an outer bottom portion of the yoke sidewall 45B in the frame 41.

Each of the external connection terminals 59 is fixed to the frame 41 in the following manner. A through hole (not shown) extending between the upper and lower faces of the attaching portion 61 is previously formed in the portion, and a cylindrical raised portion 69 is formed by a burring process around the one first opening 47A which is below the attaching portion 61. When the attaching portion 61 is to be overlaid on the gap 44A between the two yoke sidewalls 45A, 45B of the bottom plate 42, the raised portion 69 is passed through the through hole from the lower face side of the attaching portion 61 to the upper face side. A crushing process is applied on an end portion of the raised portion 69 which projects from the upper face of the attaching portion 61.

In the two lead wires 57, 58 drawn out from the voice coil 55, the one lead wire 57 is connected by soldering to the solder pad portion 67 of one of the external connection terminals 59, and the other lead wire 58 is connected by soldering to the solder pad portion 67 of the other external connection terminal 59. An outer peripheral edge portion of the diaphragm 54 is bonded and fixed to the sidewall 43 of the frame 41. The voice coil 55 is inserted into a magnetic gap 70 which is below the diaphragm 54. The magnetic circuit 53 and the vibration system 56 are held by the frame 41, thereby completing the speaker.

As shown in FIG. 7, the two lead wires 57, 58 which are drawn out from the voice coil 55 are laid in the frame 41 to form slack portions 71, 72, guided to the solder pad portions 67 of the external connection terminals 59 to which the lead wires are to be connected, and then connected thereto by soldering.

In the wire laying process, as described above, the two lead wires 57, 58 of the voice coil 55 are drawn out from the voice coil 55 at positions which are remote from the diaphragm 54, i.e., an end portion (lower end portion) which is opposite to a diaphragm-bonded end portion (upper end portion) of the voice coil 55, and from the voice coil 55 in two places corresponding to the gaps 44C, 44B between the one yoke sidewall 45C where the remaining two first openings 47C, 47B that are not used in the fixation of the external connection terminals 59 to the frame 41 exist, and the two yoke sidewalls 45A, 45B which are adjacent thereto.

Pin-like forming jigs (not shown) having a circular section shape are inserted into the two first openings 47C, 47B that are not used in the fixation of the external connection terminals 59 to the frame 41, and extend in the gaps 44C, 44B between the one yoke sidewall 45C and the two yoke sidewalls 45A, 45B which are adjacent thereto, in the outer side portion of the frame 41.

Since the outer side portion of the frame 41 is formed at the same height as the yoke portion around the yoke portion 44, the one lead wire 57 drawn out from one portion corresponding to the gap 44C in the lower end portion of the voice coil 55 is drawn out to the outer side portion of the frame 41 through the gap 44C, hooked around one of the forming jigs which extends in the gap 44C, and, in the hooked state, pulled toward the solder pad portion 67 of the external connection terminal 59 to which the lead wire is to be connected, and which is exposed in the outer bottom portion of the yoke sidewall 45A in the frame 41, to be guided to the solder pad portion 67 along the yoke sidewall 45A while forming the substantially U-like slack portion 71 in the outer side portion of the frame 41.

Since the outer side portion of the frame 41 is formed at the same height as the yoke portion around the yoke portion 44, the other lead wire 58 drawn out from one portion corresponding to the gap 44B in the lower end portion of the voice coil 55 is drawn out to the outer side portion of the frame 41 through the gap 44B, hooked around one of the forming jigs which extends in the gap 44B, and, in the hooked state, pulled toward the solder pad portion 67 of the external connection terminal 59 to which the lead wire is to be connected, and which is exposed in the outer bottom portion of the yoke sidewall 45B in the frame 41, to be guided to the solder pad portion 67 along the yoke sidewall 45B while forming the substantially U-like slack portion 72 in the outer side portion of the frame 41.

After the wire laying process is performed, the lead wires 57, 58 of the voice coil 55 are connected by soldering to the solder pad portions 67 of the external connection terminals 59 to which the lead wires are to be connected, respectively. Then, the back face of the diaphragm 54 is bonded and fixed in a concentric manner to the lead wire drawn-out end portion and opposite end portion of the voice coil 55, and the outer peripheral edge portion of the diaphragm 54 is bonded and fixed to the sidewall 43 of the frame 41.

The thus configured speaker 50 is used in, for example, a portable telephone. When an electric audio signal is supplied from an external circuit to the voice coil 55 through the pair of external connection terminals 59, the interaction between the magnetic field generated in the magnetic circuit 53 and that generated as a result of the energization of the voice coil 55 causes the voice coil 55 to vertically vibrate, and, in accordance with this, the diaphragm 54 vertically vibrates to generate a sound.

According to the above-described configuration, the lead wires 57, 58 of the voice coil 55 are drawn out from the voice coil 55 at positions which are remote from the diaphragm 54, and the openings 47C, 47B for air forming for forming the slack portions 71, 72 in the lead wires 57, 58 drawn out from the voice coil 55 are disposed in the frame 41. Therefore, the lead wires 57, 58 drawn out from the voice coil 55 at positions remote from the diaphragm 54 can be adequately subjected to the wire laying process. Even when the lead wires 57, 58 of the voice coil 55 are drawn out from the voice coil 55 at positions remote from the diaphragm 54, therefore, the vibration system 56 is less affected, and the audio performance can be prevented from being lowered.

When the lead wires 57, 58 of the voice coil 55 are drawn out from the voice coil 55 at positions remote from the diaphragm 54, the bonding face of the diaphragm can be joined in parallel to that of the voice coil. Therefore, the bonding between the diaphragm 54 and the voice coil 55 becomes stable, and the reliability of the bonding is enhanced. Moreover, the axis of the voice coil 55 is parallel to the vibration direction (the lateral direction of the sheet in FIG. 6). Under the circumstances that reduced size and thickness are strongly requested and the size of the magnetic gap 70 is restricted, therefore, the voice coil 55 is hardly contacted with the yoke sidewalls 45A, 45B, 45C, magnet 51, and pole piece 52 which are inside and outside the voice coil.

In the embodiment, a circular diaphragm ring 74 is bonded and fixed to an outer peripheral edge portion of the diaphragm 54, and the outer peripheral edge portion of the diaphragm 54 is bonded and fixed to the sidewall 43 of the frame 41 through the diaphragm ring 74. A circular baffle 75 which covers an upper opening of the frame 41 is disposed. The baffle 75 is formed by performing a pressing process on a metal plate, and has a front sound hole 76 which is opposed to the diaphragm 54. A cylindrical edge portion 77 hangs from an outer peripheral edge portion of the baffle. The edge portion 77 is fitted to the outside of the sidewall 43 to be coupled with the frame 41.

As apparent from the descriptions of Embodiments 1 and 2, the invention can be applied also to an electroacoustic device having an angular shape such as a square or a triangle, a circular electroacoustic device, and an electroacoustic device having another shape such as an oval.

[Embodiment 3]

Figure 8:
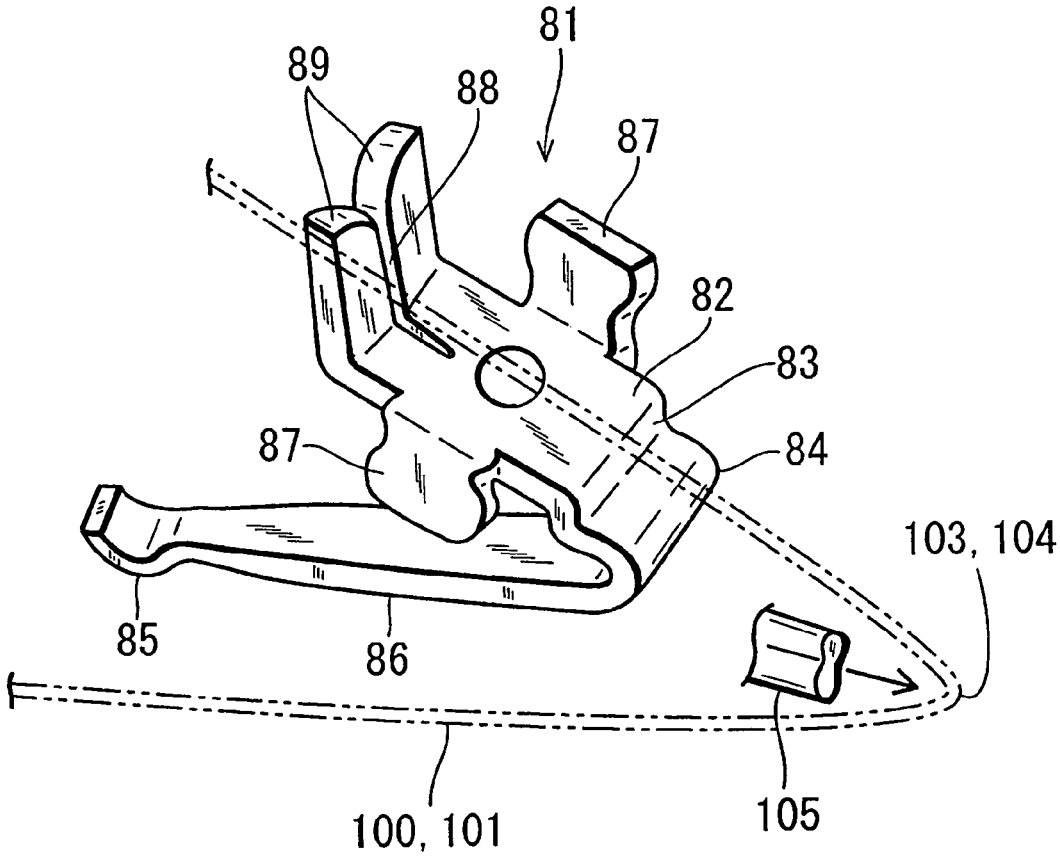
FIG. 8 is a perspective view of an external connection terminal in Embodiment 3 of the invention.

Embodiment 3 will be described with reference to FIGS. 8 and 9. FIG. 8 is a perspective view of an external connection terminal in the embodiment.

The external connection terminal 81 shown in FIG. 8 is formed by applying punching and bending processes on a thin metal plate. The terminal is integrally formed by: a fixing portion 82 to which the lead wire 57 or 58 of the voice coil 55 is to be spot-welded; a step portion 83 which is formed on the side of one end of the fixing portion 82; a cantilever-like spring piece 86 which extends is obliquely downwardly from the step portion 83 to the lower side of the fixing portion 82 through a folding portion 84, and in which a contact portion 85 is formed in a tip end portion so that the lower face is convex and the upper face is concave; a pair of press fitting pieces 87 which are bent by a bending angle of 90 degrees from the both sides of the fixing portion 82, one of which projects upwardly, and the other of which projects downwardly; and a pair of clamping pieces 89 which are bent and raised at a bending angle of 90 degrees from the other end of the fixing portion 82 that is opposite to the step portion 83, and which are laterally separated from each other by a middle slit 88.

Figure 9:
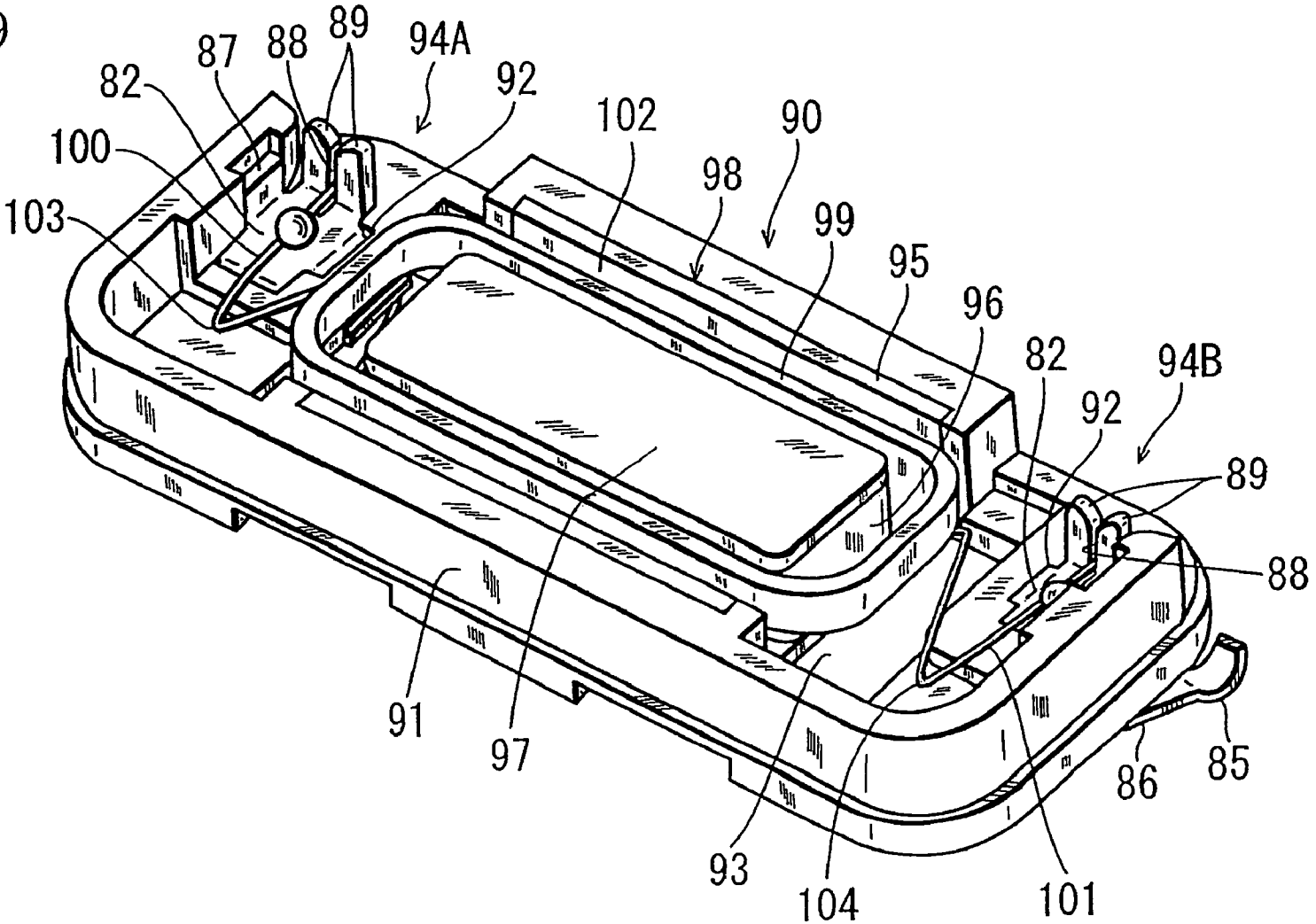
FIG. 9 is a perspective view of a state where a baffle, a diaphragm, and a diaphragm ring are made transparent in the speaker (an example of the electroacoustic transducing device) in Embodiment 3 of the invention.

FIG. 9 is a perspective view of a state where a baffle, a diaphragm, and a diaphragm ring are made transparent in a rectangular speaker (an example of the electroacoustic transducing device) to which the external connection terminal shown in FIG. 8 is attached.

The speaker 90 shown in FIG. 9 comprises a shallow bottomed rectangular tubular frame 91 which is made of a resin. A terminal insertion hole 92 is disposed in each of right and left end portions (longitudinal end portions) of a bottom portion of the frame 91, and a yoke insertion hole 93 is disposed between the terminal insertion holes 92. Notched portions 94A, 94B through which left and right side portions in the frame 91 are opened in one side (rear side) in the short direction to the outside are disposed in the sidewall of the frame 91.

A metal-made rectangular yoke 95 in which the upper and both side faces are opened is press fitted to a middle portion of the frame 91, a bottom portion of the yoke 95 is placed in the yoke insertion hole 93 of the frame 91, and a sidewall portion of the yoke 95 is placed inside the two longitudinal sidewalls of the frame 91. The inside of the yoke 95 communicates with the right and left side portions of the frame 91. A magnet 96 which is a rectangular columnar permanent magnet is bonded and fixed to the bottom portion of the yoke 95, and a pole piece 97 which is configured by a rectangular metal plate is bonded and fixed onto the magnet 96. The yoke 95, the magnet 96, and the pole piece 97 constitute a magnetic circuit 98.

On the other hand, a rectangular diaphragm (not shown) which is configured by a resin or metal film, and a rectangular tubular voice coil 99 formed by winding a conductor wire in which the surface is covered by a insulating layer are concentrically bonded and fixed to each other, and the diaphragm and the voice coil 99 constitute a vibration system (only the voice coil 99 is shown in the figure).

When the diaphragm and the voice coil 99 are to be bonded and fixed to each other, a lead wire drawn-out end portion and opposite end portion of the voice coil 99 are bonded and fixed to the diaphragm so that one lead wire 100 which is the winding start terminal of the voice coil 99, and the other lead wire 101 which is the winding end terminal are drawn out from the voice coil 99 at positions that are remote from the diaphragm.

According to the configuration, the bonding face of the diaphragm can be joined in parallel to that of the voice coil. Therefore, the bonding between the diaphragm and the voice coil 99 becomes stable, and the reliability of the bonding is enhanced.

A pair of external connection terminals 81 to which the lead wires 100, 101 drawn out from the voice coil 99 are respectively connected are attached to the frame 91. The press fitting pieces 87 of the external connection terminals 81 are press fitted into right and left side portions of the frame 91, and the fixing portions 82 of the external connection terminals 81 are placed in the yoke insertion holes 93 of the frame 91 so as to be exposed substantially flushly. The clamping pieces 89 of the external connection terminals 81 are erected in right and left side portions in the frame 91, and the spring pieces 86 are projected from the bottom faces of the right and left side portions in the frame 91.

In the two lead wires 100, 101 drawn out from the voice coil 99, the one lead wire 100 is connected by spot welding to the fixing portion 82 of one of the external connection terminals 81, and the other lead wire 101 is connected by spot welding to the fixing portion 82 of the other external connection terminal 81. An outer peripheral edge portion of the diaphragm is bonded and fixed to the sidewall of the frame 91. The voice coil 99 is inserted into a magnetic gap 102 which is below the diaphragm. The magnetic circuit 98 and the vibration system are held by the frame 91, thereby completing the speaker.

As shown in FIG. 9, the two lead wires 100, 101 which are drawn out from the voice coil 99 are laid in the right and left side portions in the frame 91 to form slack portions 103, 104, guided to the fixing portions 82 of the external connection terminals 81 to which the lead wires are to be connected, and then connected thereto by spot welding.

In the wire laying process, as described above, the two lead wires 100, 101 of the voice coil 99 are drawn out from the voice coil 99 at positions which are remote from the diaphragm, i.e., an end portion (lower end portion) which is opposite to a diaphragm-bonded end portion (upper end portion) of the voice coil 99, and from the voice coil 99 in two places which are close to the notched portions 94A, 94B that are in the rear right and left ends of the frame 91, i.e., the rear right and left edge portions of the voice coil 99.

Since the inside of the yoke 95 communicates with the longitudinal end portions of the frame 91, the one lead wire 100 which is drawn out from the rear left corner in the lower end portion of the voice coil 99 is drawn out to the outside of the frame 91 from the notched portion 94A which is in the rear left end of the frame 91, and, as shown in FIG. 8, inserted from the notched portion 94A which is in the rear left end of the frame 91, into the left side portion in the frame 91. The lead wire is forward pushed and bent by a tip end portion of a pin-like forming jig 105 in which a middle portion is narrowed, to form the slack portion 103 having a substantially V-like shape in the left side portion in the frame 91. Thereafter, the portion of the lead wire 100 which is on the tip end side with respect to the slack portion 103 is connected by spot welding to the fixing portion 82 of the external connection terminal 81 to which the lead wire is to be connected. The fixing portion is exposed in the left bottom portion in the frame 91. In a state where the lead wire 100 is clamped in the middle slit 88 of the clamping pieces 89, thereafter, the extra portion of the lead wire 100 which is on the tip end side with respect to the clamping pieces 89 is cut off.

Since the inside of the yoke 95 communicates with the longitudinal end portions of the frame 91, the other lead wire 101 which is drawn out from the rear right corner in the lower end portion of the voice coil 99 is drawn out to the right side portion in the frame 91, and, as shown in FIG. 8, inserted from the notched portion 94B which is in the rear right end of the frame 91, into the right side portion in the frame 91. The lead wire is forward pushed and bent by the tip end portion of the pin-like forming jig 105 in which the middle portion is narrowed, to form the slack portion 104 having a substantially V-like shape in the right side portion in the frame 91. Thereafter, the portion of the lead wire 101 which is on the tip end side with respect to the slack portion 104 is connected by spot welding to the fixing portion 82 of the external connection terminal 81 to which the lead wire is to be connected. The fixing portion is exposed in the right bottom portion in the frame 91. In a state where the lead wire 101 is clamped in the middle slit 88 of the clamping pieces 89, thereafter, the extra portion of the lead wire 101 which is on the tip end side with respect to the clamping pieces 89 is cut off.

After the wire laying process is performed, the back face of the diaphragm is bonded and fixed in a concentric manner to the lead wire drawn-out end portion and opposite end portion of the voice coil 99, and the outer peripheral edge portion of the diaphragm is bonded and fixed to the sidewall of the frame 91.

The thus configured speaker 90 is used in, for example, a portable telephone. When an electric audio signal is supplied from an external circuit to the voice coil 99 through the pair of external connection terminals 81, the interaction between the magnetic field generated in the magnetic circuit 98 and that generated as a result of the energization of the voice coil 99 causes the voice coil 99 to vertically vibrate, and, in accordance with this, the diaphragm vertically vibrates to generate a sound.

According to the above-described configuration, the lead wires 100, 101 of the voice coil 99 are drawn out from the voice coil 99 at positions which are remote from the diaphragm, and the openings 94A, 94B for air forming for forming the slack portions 103, 104 in the lead wires 100, 101 drawn out from the voice coil 99 are disposed in the frame 91. Therefore, the lead wires 100, 101 drawn out from the voice coil 99 at positions remote from the diaphragm can be adequately subjected to the wire laying process. Even when the lead wires 100, 101 of the voice coil 99 are drawn out from the voice coil 99 at positions remote from the diaphragm, therefore, the vibration system is less affected, and the audio performance can be prevented from being lowered.

When the lead wires 100, 101 of the voice coil 99 are drawn out from the voice coil 99 at positions remote from the diaphragm, the bonding face of the diaphragm can be joined in parallel to that of the voice coil. Therefore, the bonding between the diaphragm and the voice coil 99 becomes stable, and the reliability of the bonding is enhanced. Moreover, the axis of the voice coil 99 is parallel to the vibration direction. Under the circumstances that reduced size and thickness are strongly requested and the size of the magnetic gap 102 is restricted, therefore, the voice coil 99 is hardly contacted with the yoke 95, magnet 96, and pole piece 97 which are inside and outside the voice coil.

In the embodiment, a rectangular diaphragm ring is bonded and fixed to an outer peripheral edge portion of the diaphragm, and the outer peripheral edge portion of the diaphragm is bonded and fixed to the sidewall of the frame 91 through the diaphragm ring. A rectangular baffle which covers an upper opening of the frame 91 is disposed.

The baffle is formed by performing a pressing process on a metal plate, and has a front sound hole which is opposed to the diaphragm. A rectangular tubular edge portion hangs from an outer peripheral edge portion of the baffle.

The edge portion is fitted to the outside of the sidewall to be coupled with the frame 91.

As apparent from the descriptions of Embodiments 1 to 3, the invention can be applied to all of air forming in which a slack portion is formed by the pull-bending process in a lead wire drawn out from a voice coil, and that in which a slack portion is formed by the push-bending process in such a lead wire.

What is claimed is:

1. An electroacoustic transducing device, comprising:

a magnetic circuit having a yoke, a magnet and a pole piece, said yoke having side walls and gaps formed between said side walls;

a magnetic gap;

a vibration system having a diaphragm and a voice coil, said voice coil being placed in said magnetic gap and having lead wires; and a frame which holds said magnetic circuit and said vibration system, said frame defining a bottom plate, said bottom plate defining openings, wherein:

said lead wires are drawn out from said voice coil at positions which are remote from said diaphragm through substantially opposed ones of said gaps between said yoke side walls;

said lead wires have U or V-like slack portions therein, which have been formed by hooking the lead wires around forming jigs extending through said openings in said bottom plate during the wire laying process; and said lead wires being connected to external connection terminals, which are attached to said frame.

2. The electroacoustic transducing device according to claim 1, wherein:

said frame is formed by performing a pressing process on one sheet-like metal material, a yoke portion being integrally formed in the pressing process; and said frame being configured as a yoke-integral frame.

* * * * *